US008291945B2

(12) United States Patent
Maubois et al.

(10) Patent No.: US 8,291,945 B2
(45) Date of Patent: Oct. 23, 2012

(54) CLEANING DEVICE FOR FILLING A MACHINE

(75) Inventors: Jean-Marie Maubois, Octeville sur Mer (FR); Gilbert Piton, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 840 days.

(21) Appl. No.: 12/295,165

(22) PCT Filed: Mar. 28, 2007

(86) PCT No.: PCT/FR2007/000531

§ 371 (c)(1),
(2), (4) Date: Feb. 4, 2009

(87) PCT Pub. No.: WO2007/118968

PCT Pub. Date: Oct. 25, 2007

(65) Prior Publication Data

US 2009/0165889 A1 Jul. 2, 2009

(30) Foreign Application Priority Data

Mar. 31, 2006 (FR) ..... 06 02809

(51) Int. Cl.
*B65B 1/04* (2006.01)

(52) U.S. Cl. ..... 141/91; 141/89; 141/90; 141/144; 141/145

(58) Field of Classification Search ..... 141/91, 141/90, 87, 88, 86, 144–152; 134/104.2, 134/166 R, 183
See application file for complete search history.

(56) References Cited

U.S. PATENT DOCUMENTS

| | | | | | |
|---|---|---|---|---|---|
| 3,430,639 | A | * | 3/1969 | Roberts | 134/169 R |
| 3,447,281 | A | | 6/1969 | Buford et al. | |
| 3,513,024 | A | * | 5/1970 | Culliton | 134/22.18 |
| 3,716,083 | A | | 2/1973 | Tuma et al. | |
| 4,024,896 | A | * | 5/1977 | Ishioka et al. | 141/90 |
| 4,414,036 | A | * | 11/1983 | Anderson et al. | 134/23 |

(Continued)

FOREIGN PATENT DOCUMENTS

DE 43 43 425 6/1995

(Continued)

OTHER PUBLICATIONS

International Search Report for International Application No. PCT/FR2008/000049 dated Aug. 20, 2008.

(Continued)

*Primary Examiner* — Timothy L Maust
(74) *Attorney, Agent, or Firm* — Patterson Thuente Christensen Pedersen, P.A.

(57) ABSTRACT

The invention relates to a cleaning device for a receptacle filling machine comprising a plurality of filling spouts, and a corresponding machine. In an embodiment, the cleaning device comprises a plurality of cleaning agent recovery tubes, each recovery tube being movable between a service position in which the tube is able to recover a cleaning agent delivered by a spout, and a retracted position in which the tube is at a distance from the spout, collection apparatus to which the tubes are connected, displacement apparatus for moving the tubes between their service position and their retracted position, and sealing apparatus comprising tubular adaptors designed to fit between the spouts and the upper ends of the tubes in their service position, and to reduce axially in length, in an elastic manner, to absorb the height differences between the spouts.

18 Claims, 3 Drawing Sheets

U.S. PATENT DOCUMENTS

| | | | | | |
|---|---|---|---|---|---|
| 4,534,494 | A | | 8/1985 | Hautemont | |
| 4,987,934 | A | | 1/1991 | Groom | |
| 5,054,527 | A | * | 10/1991 | Rozier | 141/39 |
| 5,099,895 | A | | 3/1992 | Loeliger | |
| 5,145,008 | A | * | 9/1992 | Yun | 141/39 |
| 5,295,517 | A | * | 3/1994 | Ahlers | 141/1 |
| 5,348,058 | A | * | 9/1994 | Ruhl | 141/1 |
| 5,562,129 | A | | 10/1996 | Graffin | |
| 5,782,274 | A | | 7/1998 | Kaneko et al. | |
| 5,845,683 | A | * | 12/1998 | Sundby et al. | 141/90 |
| 5,865,221 | A | | 2/1999 | Ludwig et al. | |
| 6,039,058 | A | | 3/2000 | Fujikawa et al. | |
| 6,070,622 | A | | 6/2000 | Rutter | |
| 6,079,460 | A | * | 6/2000 | Ballan et al. | 141/145 |
| 6,267,157 | B1 | | 7/2001 | Gruson et al. | |
| 6,457,497 | B1 | | 10/2002 | Adriansens et al. | |
| 6,817,389 | B2 | * | 11/2004 | Dovesi | 141/145 |
| 7,686,043 | B2 | | 3/2010 | Berger | |
| 8,002,900 | B2 | * | 8/2011 | Le Roux | 134/22.11 |
| 2010/0084046 | A1 | | 4/2010 | Macquet et al. | |
| 2010/0107557 | A1 | | 5/2010 | Macquet et al. | |

FOREIGN PATENT DOCUMENTS

| | | |
|---|---|---|
| EP | 0574321 | 12/1993 |
| FR | 1 389 884 | 2/1965 |
| FR | 2 593 490 | 7/1987 |
| GB | 1 062 990 | 3/1967 |
| JP | 06-144488 | 5/1994 |
| JP | 2002-308385 | 10/2002 |

OTHER PUBLICATIONS

International Search Report for International Application No. PCT/FR2008/000048 dated Aug. 20, 2008.

Application and File History for U.S. Appl. No. 12/524,147, filed Jul. 22, 2009, inventors Macquet et al.

Application and File History for U.S. Appl. No. 12/524,150, filed Jul. 22, 2009, inventors Macquet et al.

* cited by examiner

CLEANING DEVICE FOR FILLING A MACHINE

RELATED APPLICATIONS

This application claims priority to PCT Application No. PCT/FR2007/000531 filed Mar. 28, 2007, and French Application No. 0602809, filed Mar. 31, 2006, the disclosures of which are hereby incorporated by reference in their entireties.

TECHNICAL FIELD

The invention relates to a cleaning device for a filling machine, and a filling machine fitted with such a device. The invention relates more particularly to a cleaning device for a rotary machine equipped with a plurality of filling spouts, used to fill hollow recipients, such as bottles or jars, with a food product, and a corresponding machine.

Rotary filling machines usually comprise a rotary carousel which holds a filling product tank and a plurality of filling stations connected to the tank, each filling station comprises a filling spout connected to the tank, a support system permitting a recipient to be held under the filling spout, and dosing means to supply a determined quantity of filling product into each recipient.

Such machines must be regularly cleaned using a cleaning agent, that is generally liquid, that is circulated in the machine in the place of the filling product, to remove all traces of the product, dust or other foreign bodies and/or any possible biological or bacteriological contaminants.

To limit the consumption of the cleaning agent, the use of cleaning devices is known that allow the cleaning agent to be collected when it leaves the filling spouts so that it may be recycled in a closed circuit. These cleaning devices may comprise a plurality of cleaning agent recovery tubes, wherein each recovery tube may be displaced between a service position in which said tube fits imperviously into a filling spout to recover the cleaning agent supplied by said spout, and a retracted position in which said tube is moved away from said filling spout to allow the recipients to be filled. The sealing between the filling spout and the recovery tube is provided by a wiper seal fitted in an internal annular groove on the recovery tube. The tubes are connected to a same manifold that has a mobile mounting on a fixed frame to move all of the recovery tubes between their two positions.

Such recovery tubes, fitted with wiper seals and that are fitted altogether onto the spouts, provide a good seal, even when the machine has a lot of filling spouts, with spouts at different heights. However, these recovery tubes may only be used with spouts, which have a cylindrical lower part which permits this fitting. Whereas, in many applications, in function of the form of the jet and the quality of dosing required, the filling spouts have a truncated or conical end section onto which such a recovery tube cannot be fitted. Fitting the tube onto an upper cylindrical section of the spout would require a tube whose size would be incompatible with the usual recipient support systems. For such "conical" spouts, cleaning devices could be provided which comprise recovery tubes equipped at their upper end with an O-ring capable of coming into contact with the outside conical surface of the filling spout or against the lower annular edge surrounding the spout discharge orifice. Such a seal with an O-ring is not suitable for a machine equipped with a large number of filling spouts, as in practice, the differences in height of the filling spouts would be necessarily greater than the compression of an O ring.

SUMMARY OF THE INVENTION

The present invention relates to a cleaning device which overcomes the above-mentioned disadvantages, which particularly permits a good seal to be obtained between the recovery tubes and a plurality of conical spouts of a filling machine.

To this end, the subject matter of this invention is a cleaning device for a recipient filling machine comprising a plurality of filling spouts connected to a tank of filling liquid, wherein said cleaning device comprises:

- a plurality of cleaning agent recovery tubes, wherein each recovery tube may be displaced between a service position in which said tube may recover by its upper section a cleaning agent supplied by a filling spout, and a retracted position in which said tube is moved away from said filling spout to allow the recipients to be filled,
- collection apparatus to which said recovery tubes are connected, for example by their lower section, to collect the cleaning agent recovered by said recovery tubes,
- displacement apparatus for displacing the recovery tubes between their service position and their retracted position, and
- sealing apparatus for ensuring the sealing between the filling spouts and the recovery tubes in their service position, sealing apparatus comprising tubular end pieces which can fit between the filling spouts and the upper ends of the recovery tubes in their service position, wherein said tubular end pieces are able to reduce axially in length, elastically, in order to compensate the differences in height between the filling spouts.

According to the invention, tubular end pieces are fitted between the filling spouts and the recovery tubes, wherein said ends can be compressed axially, for example by 2 to 3 mm, in the service position of the recovery tubes, to compensate the differences in height of the filling spouts on machines equipped with a large number of filling spouts, and thus ensure a good sealing between all of the filling spouts and the recovery tubes in the service position.

According to one embodiment, each tubular end piece comprises an elastomer tube, preferably fluoro-elastomer, equipped with at least one outer annular groove to form a weak zone to permit axial reduction or compression of said end piece when said end piece presses against a filling spout in the service position of the recovery tube.

According to one embodiment, a tubular end piece is assembled onto the upper end of each recovery tube, wherein said end piece comes into contact with the filling spout by means of its free end edge in the service position of the recovery tube.

In the case of conical filling spouts, each tubular end piece advantageously comprises a chamfered free end edge, defining a truncated contact surface by which said end piece can come into contact with a corresponding truncated surface of a filling spout.

Each tubular end piece may be assembled onto a recovery tube by means of a rigid connecting tube.

According to one specific aspect, the displacement apparatus can displace all of the plurality of the recovery tubes together between their service position and their retracted position, preferably by vertical translation. In one embodiment, the collection apparatus comprises an annular tube, preferably slightly tilted with respect to the horizontal axis, onto which the recovery tubes are assembled vertically by their lower end, wherein said displacement means can displace said annular tube vertically in a translation movement, wherein the filling spouts of the machine are positioned vertically, with their discharge orifices facing downwards.

The invention also relates to a rotary filling machine for filling recipients, especially plastic bottles, with a food product, comprising a rotary carousel holding a plurality of filling stations, wherein each filling station comprises a filling spout connected to filling liquid storage apparatus, particularly formed by a filling tank held by said carousel or an offset filling tank, equipped with a cleaning device as previously described.

According to one embodiment, the filling spouts are positioned substantially vertically with their discharge orifice facing downwards, wherein said spouts comprise a truncated lower section, against which the tubular end pieces of the recovery tubes come into contact by a vertical translation movement from their retracted position to their service position.

Advantageously, each filling station comprises a recipient support comprising a base support that can hold the recipients by their base and/or a clamp that can grip the recipients by their neck, wherein said recovery tubes are positioned below the base supports in their retracted position and pass through the base supports in their service position, and/or pass between the arms of the clamps in their service position.

BRIEF DESCRIPTION OF THE DRAWINGS

The invention will be more clearly understood, and other details, features and advantages will become appear in the following detailed description of a currently preferred specific embodiment of the invention, in reference to the appended drawing in which.

DETAILED DESCRIPTION OF THE DRAWINGS

FIGS. 1 to 5 illustrate a filling machine 1 equipped with a cleaning device 4 which is more particularly adapted to filling plastic bottles, B, for example made of polyethylene terephtalate, with a liquid such as water, milk or fruit juice. Of course, the invention may be applied to the filling of any type of recipient, with any type of product.

Figure 5:
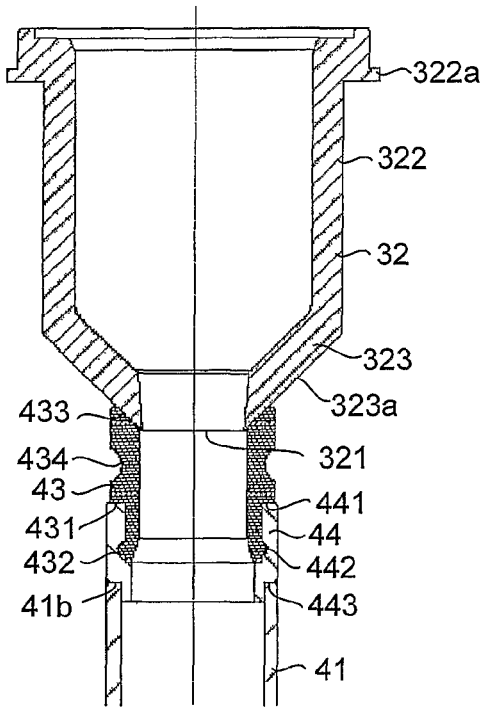
FIG. 5 is an enlarged view of the filling spout and the recovery tube in the service position of FIG. 4.
Figure 4:
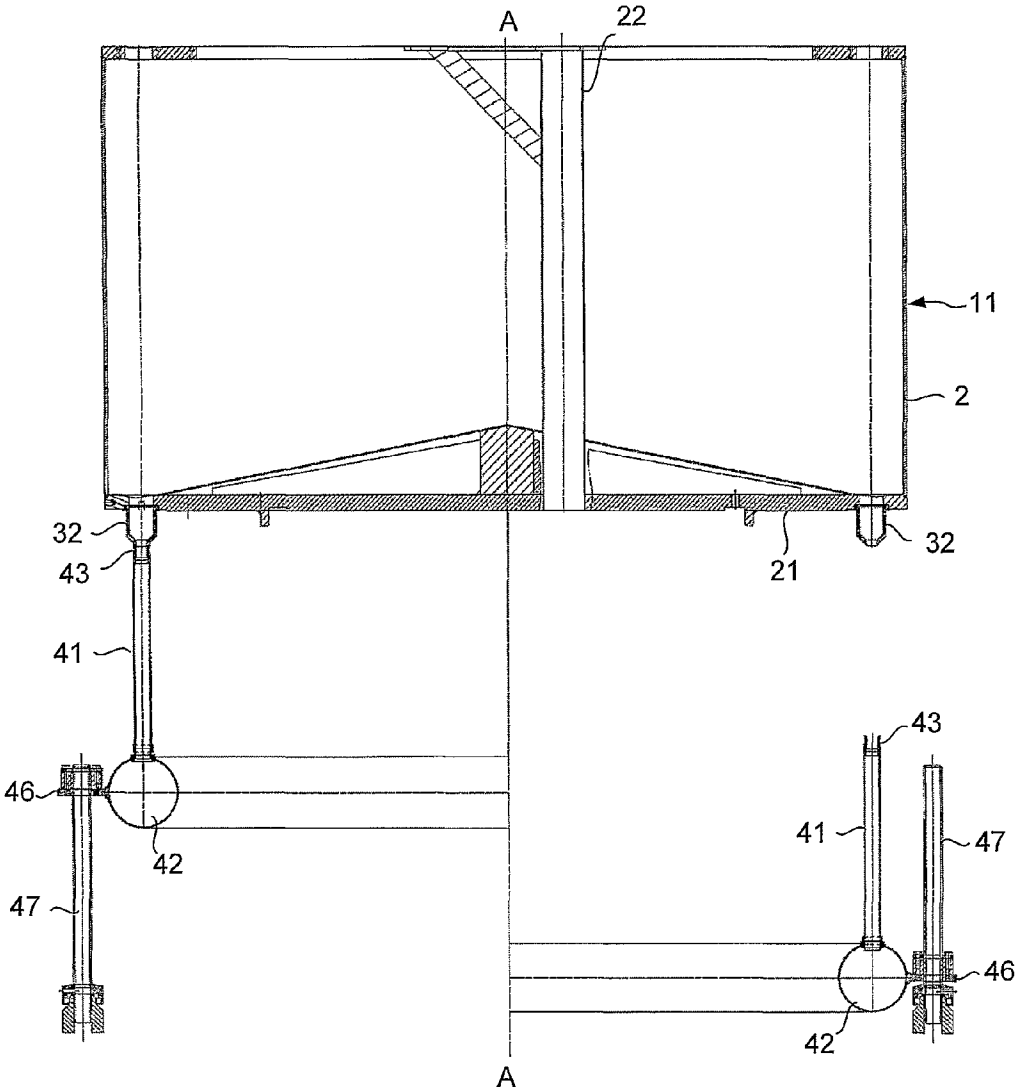
FIG. 4 depicts a diagrammatical vertical cross sectional view of the machine of FIG. 1, illustrating the tank and the cleaning device in the service position and in the retracted position.

The machine is of the rotary type, comprising a carousel 11, which is mounted rotatably on a fixed frame 12 around a vertical axis of rotation A (FIG. 5). The carousel 11 holds a cylindrical filling liquid tank 2, and a plurality of filling stations 3 positioned at a regular angular distance around the axis of rotation. Each filling station 3 comprises a filling spout 32 with a discharge orifice 321 in fluidic communication with the filling tank, and a bottle support system 31 to hold a bottle under the filling spout. In this embodiment, as may be seen more clearly in FIG. 4, the carousel is formed by the tank, and the spouts are mounted vertically directly on the bottom wall 21 of the filling tank, with their discharge orifice 321 facing downwards.

In reference to FIG. 5, each filling spout 32 comprises an upper cylindrical section 322, equipped with a flange 322*a* to connect it, in sealing manner, onto the tank, on the contour of a circular opening in its base wall, wherein this upper section extends in a lower truncated section 323 defined by the circular discharge orifice 321.

Figure 1:
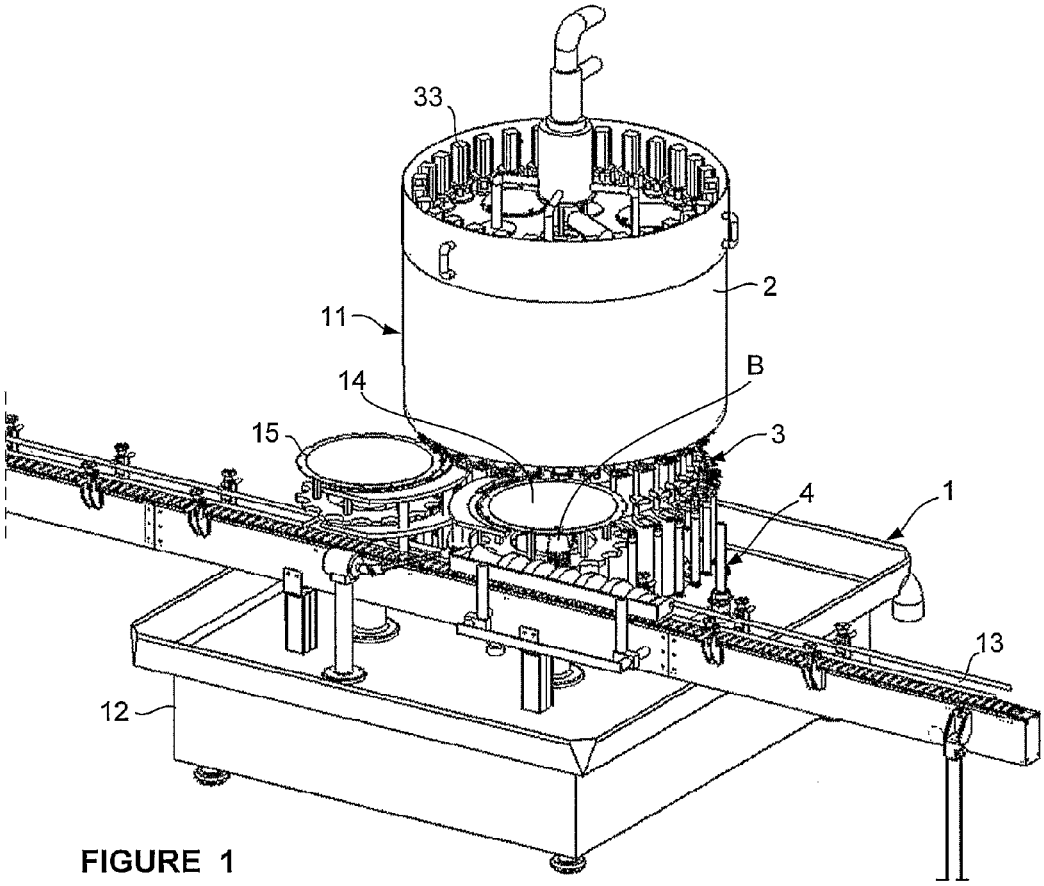
FIG. 1 depicts a diagrammatical view of a rotary filling machine equipped with a cleaning device according to an embodiment of the invention.
Figure 2:
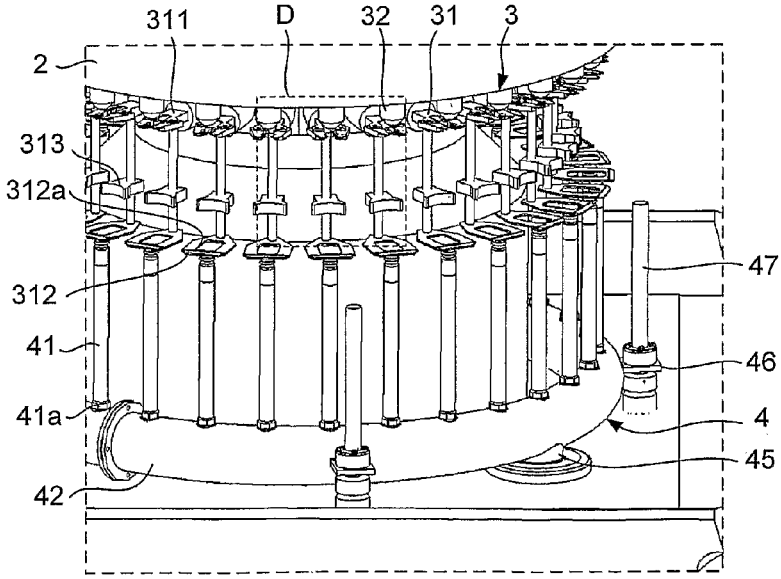
FIG. 2 depicts an enlarged partial perspective view of the machine of FIG. 1, illustrating the cleaning device with its recovery tubes in the retracted position.
Figure 3:
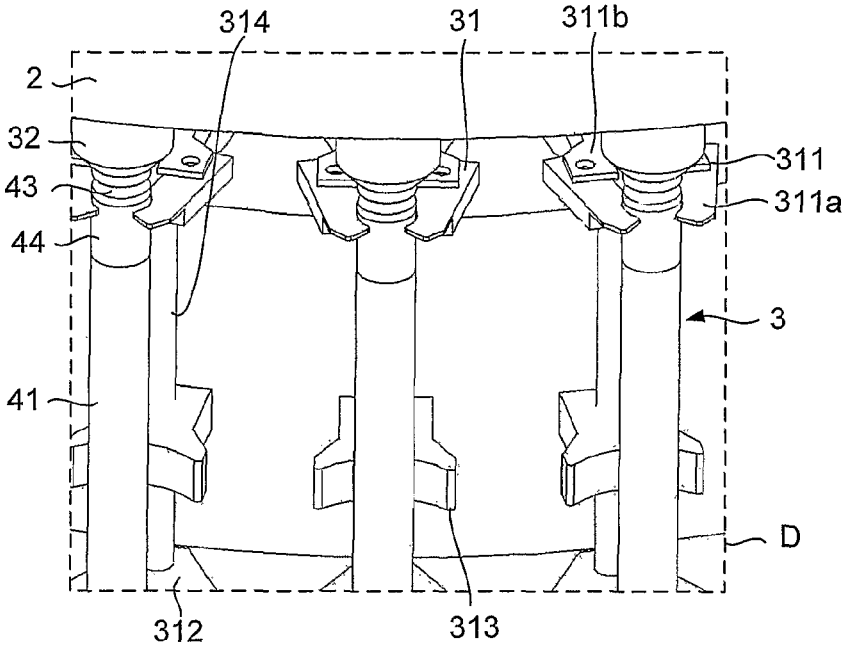
FIG. 3 depicts an enlarged view of detail D of FIG. 2, with the recovery tubes in the service position.

In reference to FIGS. 2 and 3, the bottle support system comprises a fork or clamp 311, that can grip the bottle under its flange located at the base of its neck, a base support 312 to support the bottle by its base and an intermediate spacer 313 coming into contact with the cylindrical wall of the bottle. The clamp comprises two opposite arms 311*a* which are pivotably mounted on a base 311*b*. The arms are solicited elastically by springs in a clamped bottle position, and can move apart elastically to introduce or remove a bottle. The clamp is assembled by its base onto the tank, and a vertical rod 314, mounted on the base of the clamp, supports said base support by its lower end, as well as the intermediate spacer. The base support 312 is formed by a horizontal plate equipped with a central opening 312*a* (FIG. 2) for the passage of the recovery tubes of the cleaning device as described below.

Means for dosing the product, which are themselves known, are associated to each filling spout to supply a determined quantity of product into each bottle positioned underneath the filling spout. These dosing means, which for example may be by weight, comprise a valve (not shown), fitted in the filling spout and which are opened and closed by an actuator 33 (FIG. 1) which is positioned in the upper section of the tank and is servo controlled by a weight sensor positioned on the rod holding the base support. In reference to FIG. 4, the tank is equipped with an offset vertical tube 22 for the passage of electrical cables for powering the actuator. The machine according to the invention may be equipped with other dosing means, for example of the volumetric or flow meter types, or which permit the detection of the level to which the recipient is filled.

In variants of the embodiment, depending on the filling product and the type of bottle, the vertical rod may be mounted so that it slides, for example through the base wall of the tank, between a lower loading or unloading position of the bottle in which its neck is clear of the spout, and an upper filling position in which its neck is in contact with the filling spout.

The machine is equipped with a system for feeding empty bottles, which is itself known, such as a conveyor belt 13 combined with a rotating conveyor 14, which permits the empty bottles to be engaged laterally between the clamps and on the bases supports of the support system, and an evacuation system comprising a rotating conveyor 15 combined for example with a downstream portion of the conveyor belt 13 mentioned above, permitting the filled bottles to be evacuated laterally.

The cleaning device 4 comprises a plurality of rigid recovery tubes 41, with a circular cross section, mounted vertically by their lower end 41*a* on a manifold 42 formed by a substantially horizontal annular tube. The recovery tubes are positioned at regular angular distances on the manifold and their number is the same as the number of filling spouts on the machine. Each recovery tube is equipped at its upper end with a tubular end piece 43 with a circular cross section, made of elastomer, for example Viton, that can be reduced axially in length by elastic deformation.

As can be seen more clearly in FIG. 5, the tubular end piece 43 is assembled onto the recovery tube 41 by means of an intermediate rigid connector tube, or tubular connector 44, into which the end is partially inserted. The end piece has an external shoulder 431 which comes into contact with the upper edge 441 of the tubular connector, and has on its lower section an external annular rib 432 which fits into a corresponding internal annular groove 442 on said connector. The connector is fixed, in sealing manner onto the upper end of the recovery tube, for example by partial insertion of the tube onto the connector, wherein the upper edge 41*b* of the recovery tube comes into contact against an external shoulder 443 of said connector. In one variant, the tubular end pieces are moulded directly onto the upper end of a recovery tube.

The upper edge 433 of the end piece is chamfered and defines a truncated contact surface tilted towards the inside designed to come into contact with the truncated surface 323*a*, which has a corresponding angle, of a filling spout. The internal diameter of the end piece is greater than or equal to the discharge orifice diameter 321 of the filling spouts, and preferably slightly larger, as illustrated in FIG. 5. The upper section of the end, defined by its upper edge 433 and its shoulder 431, has an annular groove 434, with a cross section that is globally semi-circular. The height and the depth of the groove, as well as the number of grooves, will be defined in function of the capacity of longitudinal reduction desired for the end piece. This longitudinal reduction capacity or vertical compression capacity, is preferably between 1 and 5 nm, for example 2 to 3 mm. In one variant of the embodiment, the tubular end piece has a rippled wall that is like an accordion.

The manifold 42, formed for example by two semi-annular sections assembled in sealing manner to one another, has a mobile mounting on the frame, under the base wall of the tank, and is slightly tilted with respect to the horizontal axis to facilitate the flow towards an evacuation duct 45 connected to said manifold. The manifold is mounted with nuts 46 (FIG. 2) onto the vertical raising screws 47 of the displacement systems, for example four in number, mounted at regular angular distances on the frame, to allow vertical displacement of the manifold and all of the recovery tubes, parallel to the axis of rotation A of the tank, between a lower retracted position and an upper service position. In the retracted position, illustrated in FIGS. 1 and 2, the tubular end pieces 43 are positioned below the bases support 312. In the service position, the recovery tubes pass through openings 312*a* in the base supports, and the connectors 44 are positioned between the arms 311*a* of the clamps, and the end pieces are in contact with the spouts. The upper service position of the manifold will be defined so as to ensure that all of the end pieces are in contact against the spouts with a minimum vertical compression of each end piece to ensure a good sealing, wherein this minimum compression is around 0.1 to 0.2 mm.

During the bottle filling operations, the cleaning device 4 is held in the lower retracted position. When the machine is cleaned, a cleaning agent is loaded into the filling liquid tank and the rotation of the tank is stopped in a position such that the recovery tubes and the filling spouts are substantially aligned vertically. The recovery tubes are then brought to the service position by actuation of the raising screws 47, wherein the connectors positioned between the clamps ensure the correct axial alignment of the spouts and the filling tubes, and the valves of the spouts are commanded to the open position to circulate the cleaning agent in the tanks. The evacuation duct 45 of the manifold is advantageously connected to the tank by a circuit equipped with a pump to recycle in closed circuit the cleaning agent to the tank.

Even though the invention has been described in relation to a specific embodiment, it is obvious that it is in no way restricted to this embodiment, and that it includes all technical equivalents of the means described as well as their combinations if they enter the scope of the invention.

The invention claimed is:

1. A cleaning device for a recipient filling machine comprising a plurality of filling spouts, each having a height, said cleaning device comprising:

a plurality of cleaning agent recovery tubes, each shiftable between a service position in which said recovery tube recovers at an upper end a cleaning agent supplied by one of said filling spouts, and a retracted position in which said tube is positioned away from said one of said filling spouts to allow recipients to be filled;

collection means to which said recovery tubes are connected, to collect the cleaning agent recovered by said recovery tubes;

displacement means for displacing at least some of the recovery tubes between the service position and the retracted position; and sealing means individually ensuring a seal between the filling spouts and the recovery tubes in the service position, said sealing means comprising tubular end pieces, individually permanently operably coupled to one of said recovery tubes and pressed against one of the filling spouts by said recovery tubes, in the service position and moved away therefrom, in the retracted position, said tubular end pieces being individually made in elastic material and axially deform elastically to reduce in length to compensate for differences in height between the filling spouts, in the service position of said recovery tubes.

2. The cleaning device according to claim 1, each tubular end piece comprising an elastomer tube fitted with at least one external annular groove.

3. The cleaning device according to claim 1, wherein the tubular end piece is operably coupled to the upper end of each recovery tube, wherein said tubular end piece comes into contact with a corresponding filling spout by a free end edge of the tubular end piece when the recovery tube is in the service position.

4. The cleaning device according to claim 3, each tubular end piece comprising a chamfered free end edge that defines a truncated contact surface adapted to contact with a corresponding truncated surface of the filling spout.

5. The cleaning device according to claim 3, each tubular end piece being operably coupled to the recovery tube by means of a rigid connecting tube.

6. The cleaning device according to claim 4, wherein the displacement means are adapted to displace all of the plurality of the recovery tubes together between their service position and their retracted position.

7. The cleaning device according to claim 6, wherein the collection means comprising an annular tube onto which the recovery tubes are assembled vertically by their lower end, wherein said displacement means can displace said annular tube vertically in a translation movement.

8. A rotary filling machine for filling recipients, comprising:

a rotary carousel which holds a plurality of filling stations, wherein each filling station comprises a filling spout having a height along an axis and connected to filling liquid storage means, each filling station comprising recipient support means comprising a base support that hold the recipients by one of a base thereof and a clamp having arms that can grip the recipients by a neck thereof;

a cleaning device comprising:

a plurality of recovery tubes, each being movable between a service position in which said recovery tube recovers at an upper end a cleaning agent supplied by one of said filling spouts, and a retracted position in which said recovery tube is moved away from said one of said filling spouts to allow recipients to be filled, each recovery tube:

being positioned below one of said base supports, in the retracted position, and passing through one of said base support and the arms of one of the clamps, in the service position, collection means to which said recovery tubes are connected, to collect the cleaning agent recovered by said recovery tubes, displacement means for displacing the recovery tubes between the service position and the retracted position, and sealing means individually ensuring a seal between the filling spouts and the recovery tubes in the service position, each sealing means comprising a tubular end piece permanently operably coupled to one of said recovery tubes and which is pressed against one of the filling spouts, in the service position, said tubular end piece being elastically deformable along said axis to compensate for differences in height between filling spouts, in the service position of said recovery tube.

9. The machine according to claim 8, the filling spouts being positioned substantially vertically with a discharge orifice of the filling spout facing downwards, wherein said spout comprises a truncated lower section, against which the tubular end pieces of the recovery tubes come into contact by a vertical translation movement from their retracted position to their service position.

10. A cleaning device for a recipient filling machine comprising a plurality of filling spouts, each having a height, said cleaning device comprising:

a plurality of recovery tubes, each shiftable between a service position in which said recovery tube recovers, at an end, a cleaning agent supplied by one of said filling spouts, and a retracted position in which said tube is positioned away from said one of said filling spouts to allow recipients to be filled;

a collection apparatus operably coupled to said recovery tubes, wherein the collection apparatus is adapted to collect the cleaning agent recovered by said recovery tubes;

a displacement apparatus adapted to shift at least some of the recovery tubes between the service position and the retracted position; and a sealing apparatus adapted to ensure a seal between the recovery tube and the corresponding filling spout when the recovery tube is in the service position, said sealing apparatus comprising tubular end pieces each permanently operably coupled to one of said recovery tubes and which is pressed against one of the filling spouts, in the service position, said tubular end pieces being individually made in elastic material and axially deform elastically to reduce in length to compensate for differences in height between filling spouts.

11. The cleaning device according to claim 10, each tubular end piece comprising an elastomer tube fitted with at least one external annular groove.

12. The cleaning device according to claim 10, wherein the tubular end piece is operably coupled to the upper end of each recovery tube, wherein said tubular end piece comes into contact with the corresponding filling spout by a free end edge of the tubular end piece when the recovery tube is in the service position.

13. The cleaning device according to claim 12, each tubular end piece comprising a chamfered free end edge defining a truncated contact surface adapted to contact a corresponding truncated surface of the filling spout.

14. The cleaning device according to claim 12, each tubular end piece being operably coupled to the recovery tube by a rigid connecting tube.

15. The cleaning device according to claim 10, wherein the displacement apparatus is adapted to shift all of the plurality of the recovery tubes between the service position and the retracted position.

16. The cleaning device according to claim 15, the collection apparatus comprising an annular tube operably coupled to the recovery tubes vertically by lower ends of the recovery tubes, wherein the displacement apparatus is adapted to displace the annular tube vertically in a translation movement.

17. A rotary filling machine for filling recipients, comprising:

a rotary carousel which holds a plurality of filling stations, wherein each filling station comprises a filling spout connected to a filling liquid storage assembly, and a recipient support assembly comprising a base support adapted to individually hold a recipient by at least one of a base and a clamp adapted to grip a neck of the recipient, wherein recovery tubes:

are positioned below the base support when the recovery tubes are in a retracted position, and, pass through at least one of the base support and arms of the clamp when the recovery tubes are in a service position; and, a cleaning device comprising:

said recovery tubes, each being movable between the service position in which said recovery tube recovers at an upper end a cleaning agent supplied by one of said filling spouts, and the retracted position in which said recovery tube is moved away from said one of said filling spouts to allow the recipients to be filled, each recovery tube:

being positioned below one of said base supports, in the retracted position, and passing through one of said base support and the arms of one of the clamps, in the service position, collection means to which said recovery tubes are connected, to collect the cleaning agent recovered by said recovery tubes, displacement means for displacing the recovery tubes between the service position and the retracted position, and sealing means individually ensuring a seal between the filling spouts and the recovery tubes in the service position, each sealing means comprising a tubular end piece permanently operably coupled to one of said recovery tubes and which is pressed against one of the filling spouts, in the service position, said tubular end piece being elastically deformable along said axis to compensate for differences in height between filling spouts, in the service position of said recovery tubes.

18. The rotary filling machine according to claim 17, the filling spouts being positioned substantially vertically with a discharge orifice of the filling spout facing downwards, wherein said filling spout comprises a truncated lower section, and wherein the truncated lower section and the tubular end piece of the corresponding recovery tube comes into contact upon a vertical translation movement of the recovery tube from the retracted position to the service position.

* * * * *